US008240492B2

(12) United States Patent
Mileti

(10) Patent No.: US 8,240,492 B2
(45) Date of Patent: Aug. 14, 2012

(54) SNAP CLOSURE

(75) Inventor: Robert J. Mileti, Torrington, CT (US)

(73) Assignee: RFR Design LLC, New Canaan, CT (US)

( * ) Notice: Subject to any disclaimer, the term of this patent is extended or adjusted under 35 U.S.C. 154(b) by 838 days.

(21) Appl. No.: 12/148,919

(22) Filed: Apr. 23, 2008

(65) Prior Publication Data

US 2009/0266834 A1 Oct. 29, 2009

(51) Int. Cl.
*B65D 41/16* (2006.01)
*B65D 41/18* (2006.01)

(52) U.S. Cl. ..... 215/317; 215/206; 215/224; 215/321; 215/305

(58) Field of Classification Search ..... 215/317, 215/272, 305, 206, 224, 321, 237; 220/281, 220/780

See application file for complete search history.

(56) References Cited

U.S. PATENT DOCUMENTS

| | | | | |
|---|---|---|---|---|
| 3,017,049 | A | 1/1962 | Powell | |
| 3,298,415 | A | 1/1967 | Klygis | |
| 3,393,816 | A | 7/1968 | Grimm | |
| 3,519,163 | A | 7/1970 | Bardell | |
| 3,627,160 | A | 12/1971 | Horvath | |
| 3,980,194 | A | 9/1976 | Costa | |
| 4,043,475 | A | 8/1977 | Wheeler | |
| 4,055,266 | A | 10/1977 | Amabili | |
| 4,071,156 | A | 1/1978 | Lowe | |
| 4,087,016 | A | 5/1978 | Towns et al. | |
| 4,375,859 | A | 3/1983 | Fillmore | |
| 4,427,126 | A | 1/1984 | Ostrowsky | |
| 4,534,481 | A | 8/1985 | Summers et al. | |
| 4,579,239 | A | 4/1986 | Hart | |
| 4,658,977 | A | 4/1987 | Crisci | |
| 5,292,017 | A | 3/1994 | Reifers | |
| 5,303,835 | A * | 4/1994 | Haber et al. | 215/247 |
| 5,582,309 | A | 12/1996 | Bruhn | |
| 5,836,466 | A | 11/1998 | Briere et al. | |
| 5,836,467 | A | 11/1998 | Montgomery | |
| 5,979,680 | A | 11/1999 | Farside | |
| 7,296,711 | B2 | 11/2007 | Hayakawa et al. | |
| 2006/0000792 | A1 * | 1/2006 | Hennebelle | 215/228 |
| 2006/0138073 | A1 | 6/2006 | Ooka et al. | |
| 2006/0186080 | A1 * | 8/2006 | Chae | 215/272 |
| 2010/0308006 | A1 * | 12/2010 | Walker-Smith | 215/305 |

FOREIGN PATENT DOCUMENTS

WO WO 01/034492 5/2001

* cited by examiner

*Primary Examiner* — Anthony Stashick
*Assistant Examiner* — Niki Eloshway
(74) *Attorney, Agent, or Firm* — Paul A. Levy

(57) ABSTRACT

A snap closure for a container includes an annular snap bead in a skirt portion. A top portion extends upwardly from the skirt portion, the top portion having horizontal slits. When the snap closure is engaged with a container, the snap beads snap onto a mating locking ring of the container. An upwards force is applied to the snap closure to disengage the closure from the container. The horizontal slits enable the top portion to flex axially to provide additional rotational leverage for disengaging the snap beads from the annular locking ring.

20 Claims, 4 Drawing Sheets

SNAP CLOSURE

BACKGROUND

1. Field of the Invention

The invention relates to a closure for a container. In particular, the closure has a horizontal slit in a top portion and a snap bead that can fit onto a mating locking ring of a container.

2. Description of Related Art

Snap closures are widely known and are of many different varieties. In one form, the snap closure has a skirt portion with a pair of annular snap beads and an inner locking lug. The snap closure can be put on a neck finish of a container having a mating annular locking ring to close the container. In some snap closures, the snap closure can be more easily removed from the container by rotating the inner locking lug to align with a notch (i.e., gap) or discontinuity located in an annular locking ring on the neck finish of the container. In such position, known as the "fire" position, the snap closure is effectively unlocked to facilitate removal. The pair of annular snap beads is circumferentially extending on the inner wall of the skirt with the midpoint of the snap beads diametrically opposite the lug for snap locking engagement with the annular locking ring. The locking lug lies in the same plane as the snap beads to likewise snap fit beneath the locking ring when the cap is manually pressed down over the container neck.

The snap closure skirt has an outer finger tab in alignment with the locking lug to provide a bearing surface for the operator's thumb or finger in lifting off the snap closure when the thumb tab and locking lug are oriented into alignment with the notch in the annular locking ring. Indicium that may be in the form of a triangle serving as a pointer is normally provided on the container neck to indicate when the locking lug is accurately in registry with the notch or gap of the annular locking ring.

The snap closure skirt is relatively stiff and rigid although sufficiently resilient so the skirt can flex radially outward upon snap closure removal as co-acting cam surfaces between the snap beads and the locking ring permit the beads to ride upwardly over a major diameter portion of the locking ring in the process of disengaging the beads from the locking ring during snap closure removal.

SUMMARY OF THE INVENTION

In one aspect of the invention, a snap closure for a container includes a skirt portion having one or more sections of an annular snap bead protruding inwardly from an inner surface of the skirt portion. A top portion extends upwardly from a top of the skirt portion. The top portion has one or more horizontal slits through a sidewall of the top portion. A section of the snap bead is capable of engagement with an annular locking ring on a neck of a container and the snap closure is capable of disengagement from the container.

In a second aspect of the invention, a snap closure for a container includes a skirt portion having one or more sections of an annular snap bead protruding inwardly from an inner surface of the skirt portion. A top portion extends upwardly from a top of the skirt portion. The top portion has one or more horizontal slits through a sidewall of the top portion with expandable covering formed over each of the horizontal slits. A section of the snap bead is capable of engagement with an annular locking ring on a neck of a container and the snap closure is capable of disengagement from the container.

DETAILED DESCRIPTION

Figure 1:
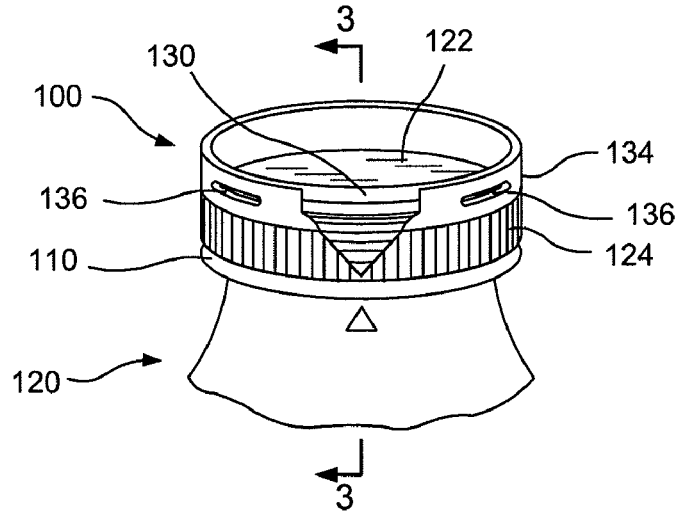
FIG. 1 is perspective view of a snap closure according to the present invention removably mounted on the neck finish of the container and shown in the fire position.
Figure 2:
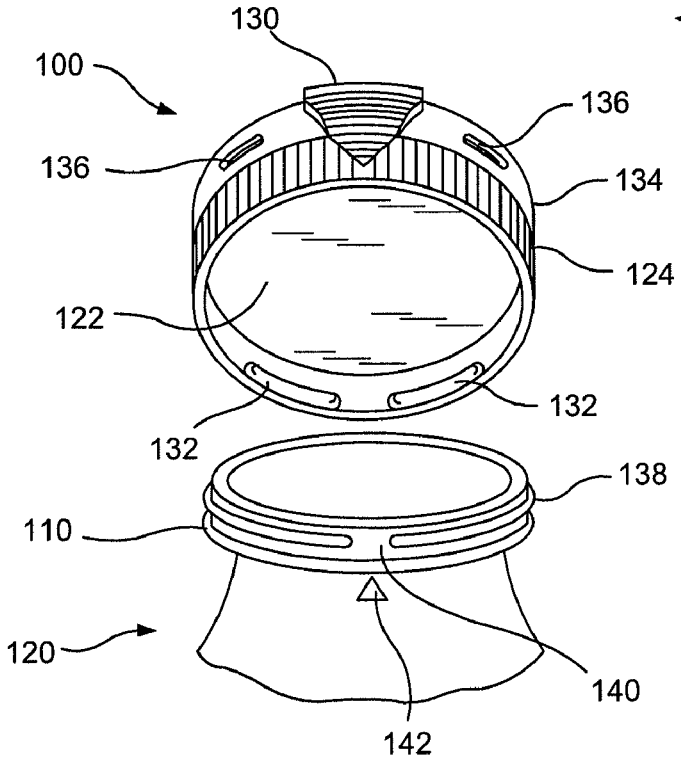
FIG. 2 illustrates the snap closure of FIG. 1 completely removed from the container.
Figure 3:
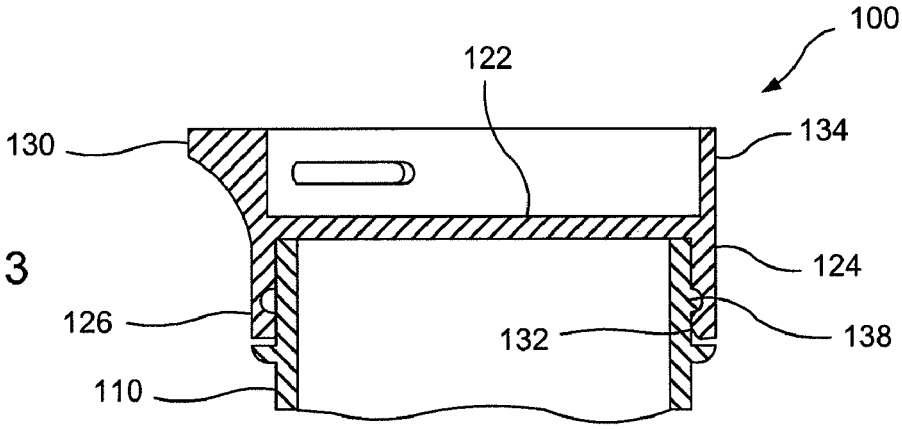
FIG. 3 illustrates a sectional view of the snap closure of FIG. 1 taken substantially along the line 3-3 of FIG. 1.

FIGS. 1-3 illustrate a snap closure 100 removably mounted to neck finish 110 of a container 120. The snap closure 100 may be of a molded high density polyethylene material or other appropriate plastic material.

The snap closure can have a container cover portion 122 and a peripheral annular skirt 124. Container cover portion 122 is located at a top end of a skirt 124 to form a closed end of the snap closure 100. Skirt 124 extends downwardly from container cover portion 122 and has a radially inwardly extending locking lug 126, and can also have a radially outwardly extending finger tab 130 in alignment with the locking lug. The snap closure skirt 124 likewise has a radially inwardly extending rib structure that may be in the form of spaced snap beads 132 having a midsection diametrically opposite locking lug 126. The snap beads 132 can be circumferentially spaced from the locking lug 126 and lie in substantially the same radial plane therewith.

The snap closure includes a top portion 134 extending upwardly from the top of the skirt 124. Top portion 134 can have an outside surface with a profile such as a corrugated pattern. Top portion 134 has one or more horizontal slits 136. Horizontal slits 136 enable the top portion 134 to flex in an axial direction as described in more detail below.

Snap closure 100 can be snap fitted to the neck finish 110 of a container 120. The neck finish has a radially outwardly extending annular locking ring 138 that can have a notch 140 therein forming a gap, and indicium 142, such as a triangular shape, on the neck finish in alignment with notch 140.

In the rotative position of FIGS. 1, 2, and 3, with finger tab 130 aligned with indicium 142, a user can apply an upward force against the finger tab for urging lug 126 upwardly through notch 140 incident to removal of the snap closure 100.

The locking lug and/or snap beads as well as the locking ring may be appropriately rounded to effect cooperative camming action as the cap is both snap fitted to the neck finish and as the snap closure is removed therefrom. The snap closure skirt resiliently expands upon flexing during the process of both snap fitting the snap closure in place and upon snap closure removal. The skirt has a hoop strength that can limit resilient expansion and flexing of the skirt in a radially outwardly direction upon snap fitting the locking lug and snap beads to the locking ring and upon releasing the snap beads from the locking ring.

Figure 4:
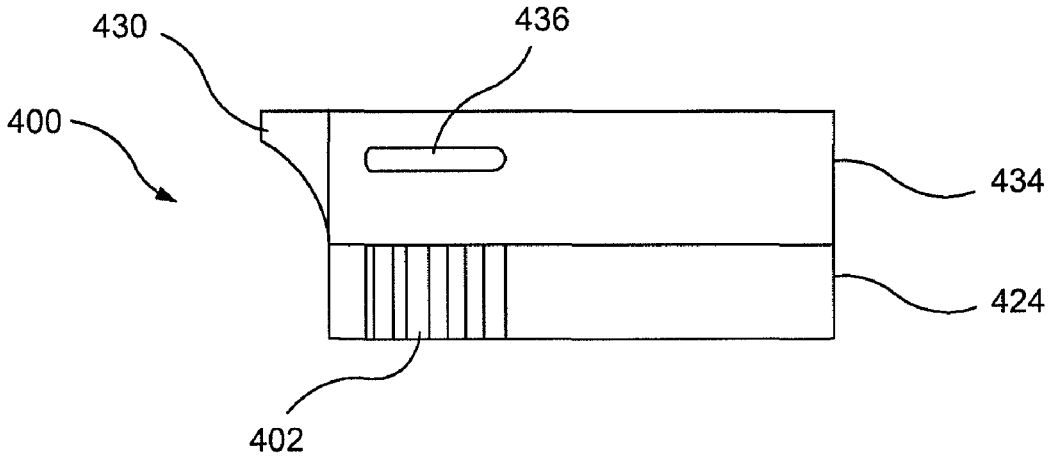
FIG. 4 illustrates a schematic view of an embodiment of a snap closure including an optional accordion-shaped portion in the skirt.
Figure 4:
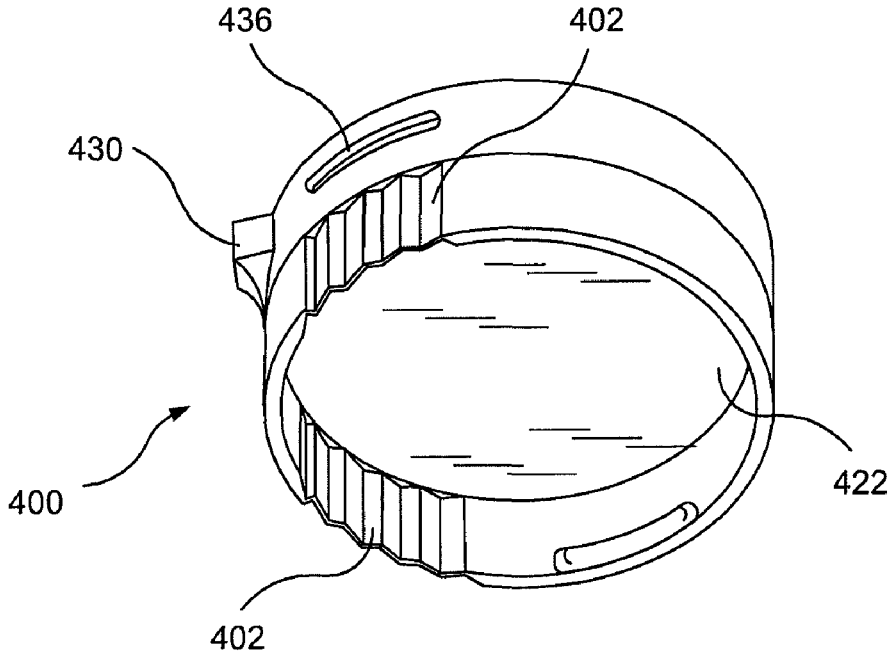

FIG. 4 is an embodiment of snap closure 400 including optional accordion-shaped portions 402 disposed in a skirt 424 below a container cover portion 422. An accordion-shaped portion 402 can be located adjacent one or both sides of a finger tab 430. Accordion-shaped portions 402 can reduce the force required to remove the snap closure from a container by enabling the snap closure skirt 424 to flex radially outwardly more easily than without the accordion-shaped portions. One or more slits 436 are provided through the top portion 434 and may be located above each accordion-shaped portion. Slits 436 enable the snap closure to flex axially and can reduce the force necessary to remove the snap closure from a container, and replace the snap closure on the container.

FIGS. 5A-5E illustrate various views of a snap closure 500 of the present design having a top portion 534 in the shape of a crown that extends upwardly and outwardly from the top of a skirt 524. The crown-shaped top portion can move the lift-off fulcrum point upwardly and laterally farther away from the locking ring (not shown). Moving the fulcrum point in this way increases the leverage the user has to snap the snap closure off the top of the container. Increasing the leverage decreases the lift-off force required. The crown also can provide a larger finger tab 530. Optionally, at least one accordion-shaped portion 502 can be incorporated into the skirt 524 of the snap closure to reduce the lift-off force required to remove the snap closure from the container.

One or more horizontal slits 536 are provided through a sidewall of the top portion 534. Horizontal slits 536 enable a portion of peripheral edge of top portion 534 to bend in an axial direction "A" illustrated in FIG. 5C. Snap closure 500 can include a container cover portion 522 located at a top end of skirt 524, below horizontal slits 536, to form a closed end of the snap closure 500.

In an implementation, the horizontal slits are completely through a sidewall of the top portion. The horizontal slits may be located directly over optional accordion-shaped portions 502 in skirt 524. The length of the horizontal slits may be less than or greater than the length of the accordion-shaped portion 502. An expandable covering may be formed over the horizontal slits 536. The expandable covering can cover the horizontal slits while still enabling a peripheral edge of the top portion 534 to bend in the axial direction. The expandable covering can be, for example, a stretchable material or a material arranged in parallel folds such as the accordion-shaped portion of the skirt. In an implementation, the expandable portion of the slits may be formed by having the slits not being entirely through the top portion.

Figure 5D:
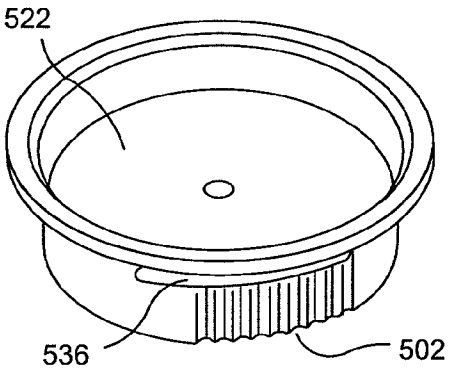
FIGS. 5A-5E illustrate an embodiment of snap closure having a crown-shaped top portion.
Figure 5E:
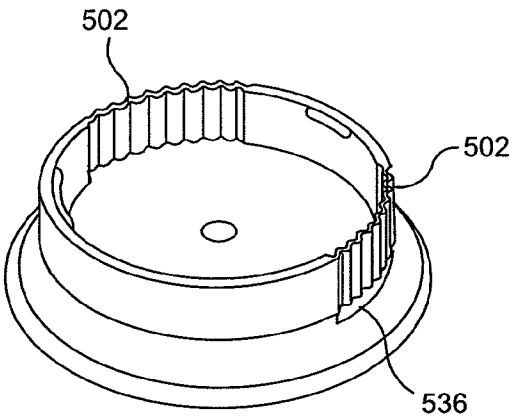
Figure 5C:
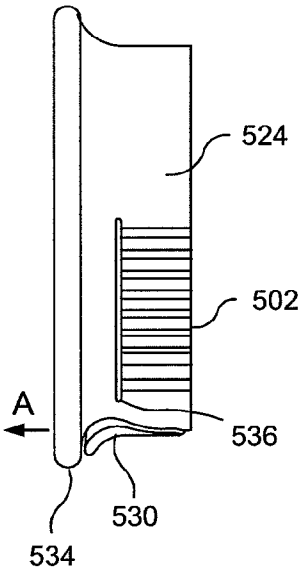
Figure 5A:
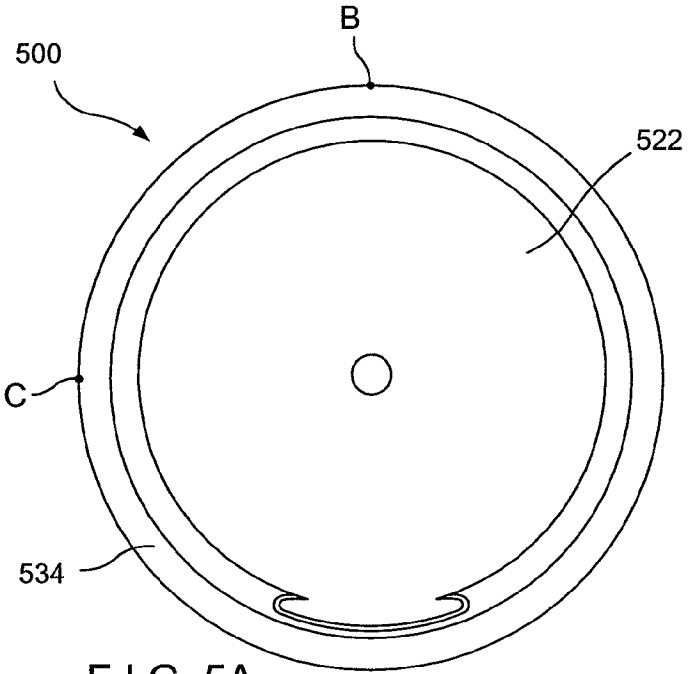
Figure 5B:
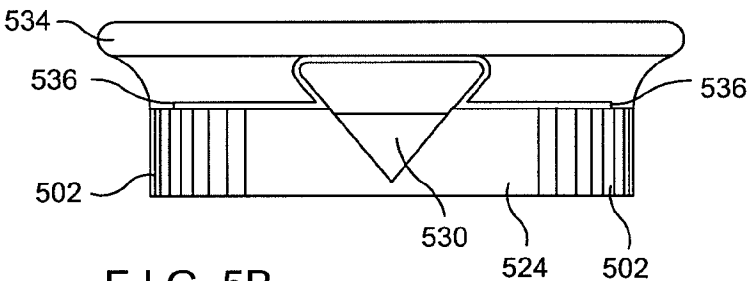

In an implementation, a horizontal slit may extend around the circumference of the crown and preferably extend from a point adjacent finger tab 530 to a point less than half way around the circumference of the crown to a point "B" on the crown diametrically opposite finger tab 530, illustrated as point "C" in FIG. 5A.

Horizontal slits 536 can reduce the force necessary to disengage the snap closure from a container. When a force is applied to the top portion, a portion of the top portion can move axially thereby providing additional rotational leverage for disengaging the snap beads from an annular locking ring on the container.

Figure 6C:
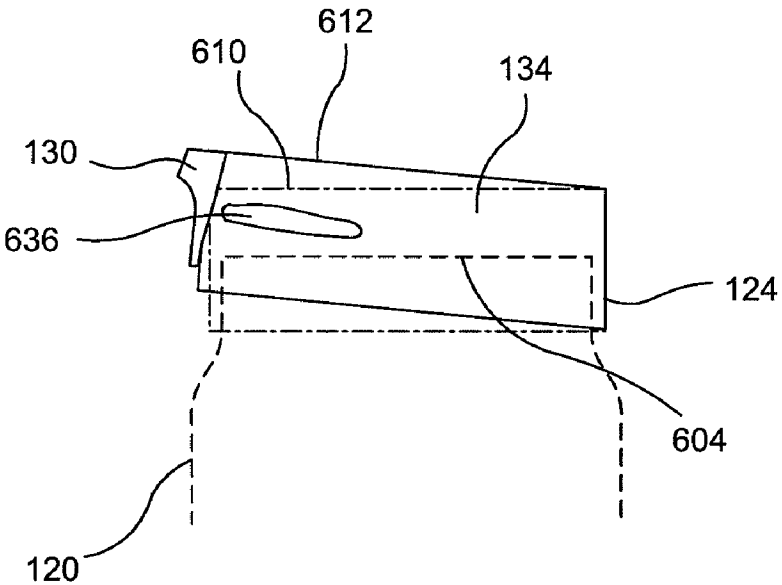
FIGS. 6A-6C illustrate the snap closure of FIG. 1 during disengagement from the container.
Figure 6B:
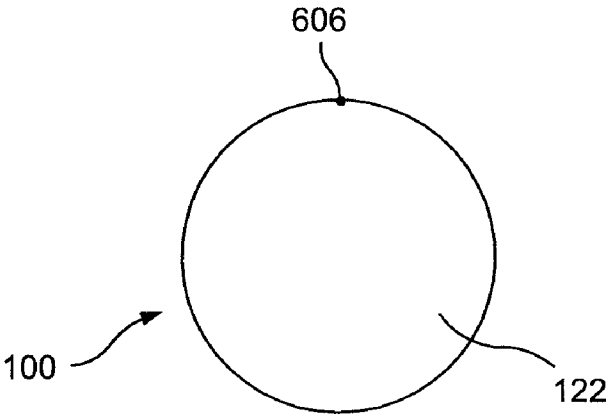
Figure 6A:
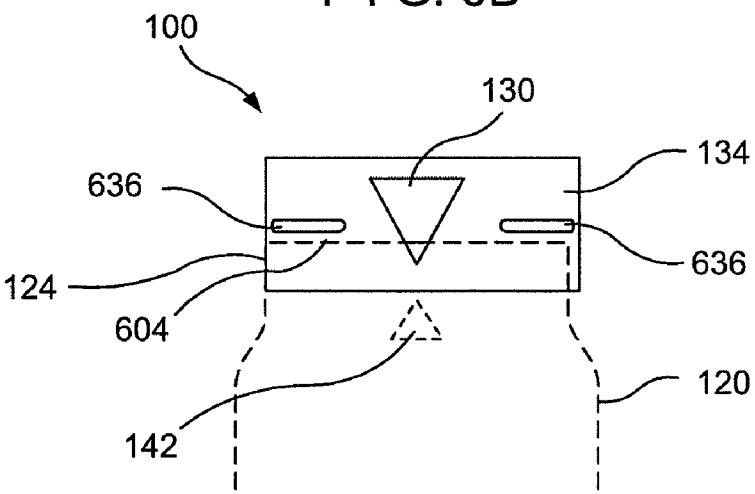

FIGS. 6A-6C illustrate the snap closure of FIG. 1 and having one or more horizontal slits 636 through a sidewall of top portion 134 during removal from container 120. Top portion 134 extends upwardly from skirt portion 124. Snap closure 100 can have a container cover portion 122 that covers a top edge 604 of container 120 when the snap closure is snapped onto the container.

FIG. 6A illustrates snap closure 100 atop container 120, which is not part of the present invention. FIG. 6B is a top view thereof. When snap closure 100 is snapped in place on container 120, slits 636 are located above the top edge 604 of container 120. Slits 636 can extend circumferentially around top portion 134 from a point adjacent finger tab 130 towards a point 606 diametrically opposite the indicium on top portion 134. Container cover portion 122 can provide a covering for container 120 to retain any contents of the container there within when the snap closure 100 is snapped in place onto container 120.

Snap closure 100 can be removed from container 120 by applying an upwards force thereto. In an embodiment having a fire position as discussed above, the snap closure can be more easily removed when the snap closure is rotated to the fire position where finger tab 130 on the closure is aligned with indicium 142 on the container.

FIG. 6C illustrates an exaggerated view of the movement of top portion 134 during removal of the snap closure. Horizontal slits 636 can reduce the force necessary to disengage the snap closure from the container. When a force is applied to top portion 134, top portion 134 can move axially from a starting position 610 to a position 612 to provide additional rotational leverage for disengaging the snap beads from an annular locking ring (not shown) on the container as discussed herein above.

Other embodiments are within the scope of the following claims.

What is claimed is:

1. A snap closure for a container, comprising:

a skirt portion having one or more sections of an annular snap bead protruding inwardly from an inner surface of the skirt portion; and a top portion extending upwardly from a top of the skirt portion, the top portion having one or more horizontal slits at least partially through a sidewall of the top portion, the slits extending inwardly from an outside surface of the sidewall, wherein a section of the snap bead is capable of engagement with an annular locking ring on a neck of a container and the snap closure is capable of disengagement from the container, and wherein the one or more horizontal slits are located to enable the top portion to flex axially when the snap closure is being removed.

2. The snap closure of claim 1, comprising a locking lug inwardly protruding from the inner surface of the skirt portion.

3. The snap closure of claim 1, wherein the skirt portion includes one or more accordion-shaped portions extending vertically along a peripheral edge of the skirt portion, and spaced apart from the snap beads, the accordion-shaped portions being located to enable the skirt portion to flex radially outwardly when the snap closure is being removed from the container, or replaced.

4. The snap closure of claim 3, wherein the one or more horizontal slits are located directly above a respective accordion-shaped portion.

5. The snap closure of claim 1, wherein the top portion is crown-shaped extending upwardly and outwardly from the skirt portion.

6. The snap closure of claim 5, wherein the skirt portion and the top portion are circular and each has a respective diameter, and wherein a top end of the top portion has an equal or larger diameter than a diameter of the skirt portion.

7. The snap closure of claim 1, comprising a container cover that closes an end of the snap closure below the slits.

8. A snap closure for a container, comprising:

a skirt portion having one or more sections of an annular snap bead protruding inwardly from an inner surface of the skirt portion;

a top portion extending upwardly from a top of the skirt portion, the top portion having one or more horizontal slits at least partially through a sidewall of the top portion, the slits extending inwardly from an outside surface of the sidewall; and an expandable covering formed over each of the horizontal slits, wherein a section of the snap bead is capable of engagement with an annular locking ring on a neck of a container and the snap closure is capable of disengagement from the container, and wherein the one or more horizontal slits are located to enable the top portion to flex axially when the snap closure is being removed.

9. The snap closure of claim 8, wherein the skirt portion includes one or more accordion-shaped portions extending vertically along a peripheral edge of the skirt portion, and spaced apart from the snap beads, the accordion-shaped portions being located to enable the skirt portion to flex radially outwardly when the snap closure is being removed from the container.

10. The snap closure of claim 9, wherein the one or more horizontal slits are located directly above a respective accordion-shaped portion.

11. The snap closure of claim 10, wherein the expandable covering is arranged in parallel folds.

12. The snap closure of claim 8, wherein the top portion is crown-shaped extending upwardly and outwardly from the skirt portion.

13. The snap closure of claim 12, wherein the skirt portion and the top portion are circular and each has a respective diameter, and wherein a top end of the top portion has an equal or larger diameter than a diameter of the skirt portion.

14. The snap closure of claim 8, comprising a container cover that closes an end of the snap closure below the slits.

15. The snap closure of claim 1, comprising a container having a locking ring mateable with the one or more sections of the snap bead.

16. The snap closure of claim 1, comprising:

a locking lug extending inwardly from an inner surface of the skirt portion; and a finger tab extending outwardly from an outer surface of the portion in alignment with the locking lug.

17. The snap closure of claim 16, comprising:

a container having a locking ring mateable with the one or more sections of the snap bead, the locking ring having a gap therein, wherein the snap closure is removable when the locking lug is in alignment with the gap.

18. The snap closure of claim 8, comprising a container having a locking ring mateable with the one or more sections of the snap bead.

19. The snap closure of claim 8, comprising:

a locking lug extending inwardly from an inner surface of the skirt portion; and a finger tab extending outwardly from an outer surface of the portion in alignment with the locking lug.

20. The snap closure of claim 19, comprising:

a container having a locking ring mateable with the one or more sections of the snap bead, the locking ring having a gap therein, wherein the snap closure is removable when the locking lug is in alignment with the gap.

* * * * *